US010081209B2

(12) United States Patent
Barron et al.

(10) Patent No.: US 10,081,209 B2
(45) **Date of Patent: *Sep. 25, 2018**

(54) METHODS AND SYSTEMS FOR DETERMINING A PRINTING POSITION

(71) Applicant: HP INDIGO B.V., Houston, TX (US)

(72) Inventors: Rodolfo Jodra Barron, Boise, ID (US); Sagi Refael, Nes Ziona (IL); Eyal Bodinger, Nes Ziona (IL); Pavel Blinchuk, Nes Ziona (IL)

(73) Assignee: HP INDIGO B.V., Amstelveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/686,487

(22) Filed: Aug. 25, 2017

(65) Prior Publication Data

US 2017/0368856 A1 Dec. 28, 2017

Related U.S. Application Data

(63) Continuation of application No. 14/417,584, filed as application No. PCT/US2012/048546 on Jul. 27, 2012, now Pat. No. 9,776,441.

(51) Int. Cl.
*B41J 29/38* (2006.01)
*B41J 29/393* (2006.01)
(Continued)

(52) U.S. Cl.
CPC ..... *B41J 29/393* (2013.01); *B41J 3/60* (2013.01); *B41J 11/46* (2013.01)

(58) Field of Classification Search
USPC ..... 347/5, 9, 16, 19, 234
See application file for complete search history.

(56) References Cited

U.S. PATENT DOCUMENTS 7,583,282 B2 9/2009 Yamauchi
7,860,425 B2 12/2010 Mirna et al.
(Continued)

FOREIGN PATENT DOCUMENTS

EP 1266756 A2 12/2016
JP 2003-054061 2/2003
(Continued)

OTHER PUBLICATIONS

Hoffman, "Xerox ColorQube 8700/X", pcmag.com•, http://www.pcmag.com/article2/0,2817,2406102,00.asp; Jun. 21, 2012; 5 pp.
(Continued)

*Primary Examiner* — Lam Nguyen
(74) *Attorney, Agent, or Firm* — Fabian VanCott

(57) ABSTRACT

A method for determining a printing position, such as for image-on-paper registration in a printer or photocopying machine, is disclosed. A fiducial mark pattern comprising a plurality of fiducial marks at predefined relative distances is provided on a printing medium, and is scanned. The fiducial marks and a first edge of the printing medium are identified in a scanned representation of the printing medium. A first distance between the first edge and a first fiducial mark is determined, and a second distance between a second fiducial mark and a third fiducial mark are likewise determined from the scanned representation of the printing medium. The distance between the fiducial mark pattern and the first edge is computed based on both the determined first distance and the determined second distance. The invention also relates to a corresponding system and a computer-readable medium for determining a printing position.

20 Claims, 6 Drawing Sheets

(51) Int. Cl.
*B41J 3/60* (2006.01)
*B41J 11/46* (2006.01)

(56) References Cited

U.S. PATENT DOCUMENTS

| | | | |
|---|---|---|---|
| 2002/0024681 | A1 | 2/2002 | Leonhardt |
| 2006/0033943 | A1 | 2/2006 | Leonhardt |
| 2011/0032557 | A1 | 2/2011 | Bernstein et al. |
| 2011/0102817 | A1 | 5/2011 | Hoover et al. |
| 2011/0122455 | A1 | 5/2011 | Gaynor et al. |
| 2011/0194131 | A1 | 8/2011 | Hunter et al. |

FOREIGN PATENT DOCUMENTS

| | | |
|---|---|---|
| JP | 2009-302608 | 12/2009 |
| JP | 2010-201687 | 9/2010 |
| WO | WO-2014018053 | 1/2014 |

OTHER PUBLICATIONS

International Search Report and Written Opinion for PCT/US2012/048546 dated Mar. 29, 2013; 12 pp.

METHODS AND SYSTEMS FOR DETERMINING A PRINTING POSITION

BACKGROUND

Accurate image-on-paper registration is an important aspect in the printing and image reproduction industry. Single-sided (or "simplex") registration is concerned with adjusting the position of a printed image with respect to the edges of the printing medium. Double-sided (or "duplex") image-on-paper registration poses additional challenges, since it needs to make sure that the image position on the back side accurately matches the image position on the front side of the printing medium, so to avoid "show-through" effects. Shrinkage of the paper that may occur during the printing is an additional concern for the duplex registration. Due to the shrinkage, the paper may be smaller when the duplex image is transferred than it was for the simplex image. Depending on the printing medium and ink, there may be significant variations in the shrinkage factor.

Registration marks have conventionally been used to assist both in the simplex and in the duplex registration. These marks are printed on the front side and/or back side of the printing medium, and a horizontal distance and vertical distance between the marks and the respective edges of the printing medium are measured. These measurements allow to adjust the position of the image on the paper for subsequent printouts. Triangular marks for manual measurements have conventionally been used. But manual measurements are slow and cumbersome, and the triangular marks are not particularly well-suited for automatic image-on-paper registration. Some printers feature an automatic image-on-paper registration. These printers print a fiducial mark pattern on the front side and/or back side of the printing medium. A scanner is then employed to scan the printed medium and the fiducial marks, and the distance between the edges of the printing medium and the fiducial marks is determined automatically from the scanned representation of the printing medium. But these known systems have sometimes failed to provide sufficiently accurate distance measurements, resulting in an insufficient adjustment of front-to-back printing. Some known systems require an undesirably long time to perform an image-on-paper registration.

The present invention overcomes these and other shortcomings of the prior art and provides an improved method and system for determining and adjusting a printing position.

DETAILED DESCRIPTION

Figure 1:
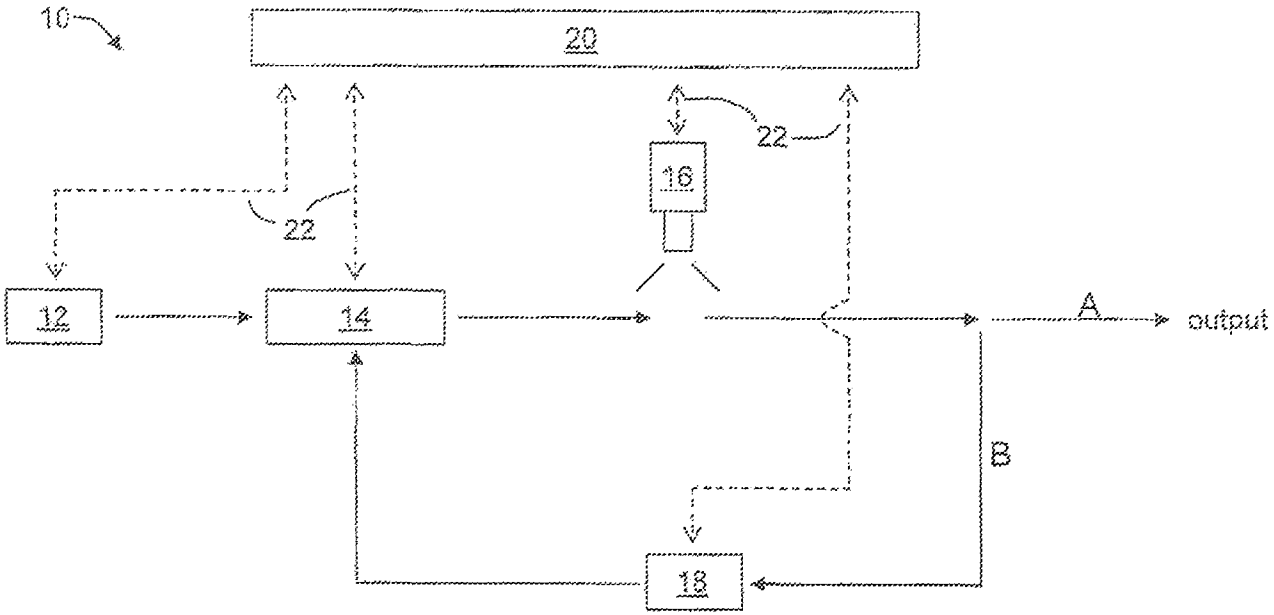
FIG. 1 schematically illustrates a system for determining a printing position in an example of the invention.

The invention relates to a method for determining a printing position with the steps of providing a fiducial mark pattern on a printing medium, said fiducial mark pattern comprising a plurality of fiducial marks at predefined relative distances, capturing an image of said printing medium, and identifying said fiducial marks in a captured representation of said printing medium. The method further comprises the steps of identifying a first edge of said printing medium in said captured representation of said printing medium, determining a first distance between said first edge and a first fiducial mark of said fiducial mark pattern from said captured representation of said printing medium, determining a second distance between a second fiducial mark of said fiducial mark pattern and a third fiducial mark of said fiducial mark pattern from said captured representation of said printing medium, and computing a distance between said fiducial mark pattern and said first edge based on said determined first distance and said determined second distance.

In particular, said method may comprise a step of printing said fiducial mark pattern on said printing medium.

The printing position may be determined and/or adjusted automatically in the present invention.

In a further aspect, the invention relates to a system for determining a printing position, comprising a printing unit to print a fiducial mark pattern on a printing medium, said fiducial mark pattern comprising a plurality of fiducial marks at predefined relative distances; an image sensing unit to capture an image of said printing medium; an identification unit to identify said fiducial marks in a captured representation of said printing medium and to identify a first edge of said printing medium in said captured representation of said printing medium; and a determination unit to determine a first distance between said first edge and a first fiducial mark of said fiducial mark pattern from said captured representation of said printing medium, and further to determine a second distance between a second fiducial mark of said fiducial mark pattern and a third fiducial mark of said fiducial mark pattern from said captured representation of said printing medium, and to compute a distance between said fiducial mark pattern and said first edge based on said determined first distance and said determined second distance.

In a further aspect, the invention also relates to a computer-readable medium storing computer-readable instructions thereon, such that when said instructions are read in a computer system connected to or integrated into a system for determining a printing position, cause said system to perform a method with the steps of capturing an image of a printing medium provided with a fiducial mark pattern, said fiducial mark pattern comprising a plurality of fiducial marks at predefined relative distances; identifying said fiducial marks in a captured representation of said printing medium; identifying a first edge of said printing medium in said captured representation of said printing medium; determining a first distance between said first edge and a first fiducial mark of said fiducial mark pattern from said captured representation of said printing medium; determining a second distance between a second fiducial mark of said fiducial mark pattern and a third fiducial mark of said fiducial mark pattern from said captured representation of said printing medium; and computing a distance between said fiducial mark pattern and said first edge based on said determined first distance and said determined second distance.

Computing the distance between the fiducial mark pattern and the first edge based on said measured first distance and said measured second distance allows to determine the distance between the fiducial mark pattern and the first edge with enhanced accuracy. If the true second distance on the printing medium is known or can be estimated reliably, the first distance can be derived by scaling from the measurements of the first distance and the second distance in the captured representation. The measured second distance between the second fiducial mark and the third fiducial mark may hence be used as a reference or benchmark in the captured representation. Applying this reference to the measured first distance between the first edge and the first fiducial mark of the mark pattern allows to compute the distance between the fiducial mark pattern and the first edge reliably, quickly, and with enhanced accuracy.

In particular, comparing said determined second distance to a predefined relative distance between the second fiducial mark and the third fiducial mark allows to determine a correction factor or scaling factor which, when applied to the determined first distance provides an accurate measure for the distance between the first edge and the first fiducial mark, and hence allows to adjust the printing position with high accuracy.

FIG. 1 is a schematic representation of a printing system 10 in which the present invention may be employed. The printing system 10 may be any device used to generate printouts, such as a printer, a photocopying machine, a bookmaking machine, or a multi-function machine which performs a print outputting function. The path of a printing medium through the printing system 10 is designated by solid arrows in FIG. 1.

FIG. 1 is a conceptional and schematic drawing intended to assist in understanding the present invention, and merely serves to show some of the components that may be present in a printing system 10 according to an example of the invention. The configuration of the elements and their positions in the printing system 10 may vary depending on the field of application and the system requirements.

The printing system 10 comprises a paper feeding unit 12, a printing unit 14 and an image sensing unit 16 as well as a duplex unit 18 and a control unit 20. The paper feeding unit 12 feeds a printing medium to the printing unit 14. The printing medium may be a sheet of paper, but may also be any other medium on which images may be printed, comprising transparencies, film, fabric, plastic, photo-finishing papers, or any other coated or non-coated substrate media. The printing unit 14 may print a predefined image on the front side or the back side of the printing medium. Operation of the paper feeding unit 12 and the printing unit 14 are controlled by means of the control unit 20, which communicates with the paper feeding unit 12 and the printing unit 14 via respective data lines 22.

The image that the printing unit 14 prints on the printing medium may be any image, such as text or drawings or a combination thereof, but can in particular be a fiducial mark pattern for automatically determining and adjusting a printing position, as will now be described in further detail with reference to FIG. 2.

Figure 2:
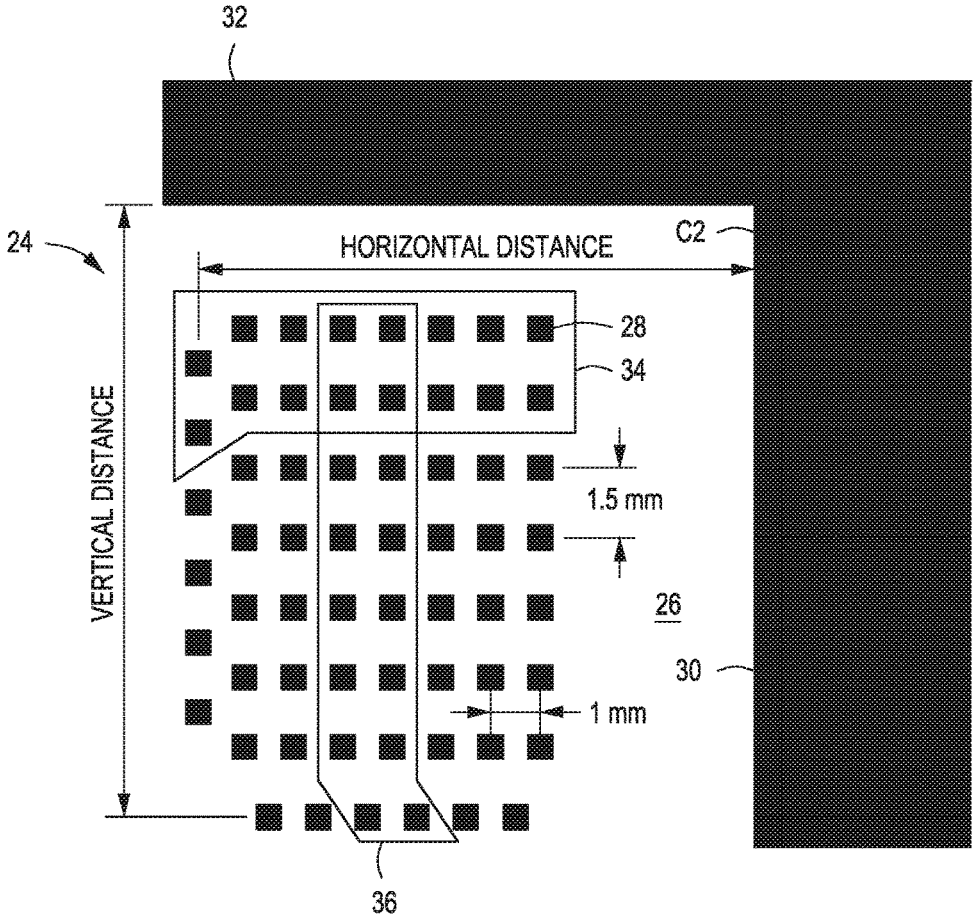
FIG. 2 shows a printing medium with a fiducial mark pattern according to an example of the invention.

FIG. 2 shows a fiducial mark pattern 24 that is printed on the front side 26 in the vicinity of the upper right corner C2 of a printing medium. The pattern 24 comprises a plurality of fiducial marks 28 that are arranged in a plurality of columns and a plurality of rows, with predefined relative distances. In the example shown in FIG. 2, the fiducial marks 28 are printed squares. However, fiducial marks in any other form may likewise be employed, such as rectangles or circles. In the example shown in FIG. 2, the fiducial mark pattern 24 comprises seven rows and seven columns of fiducial marks, plus an additional column and an additional row with only six fiducial marks each that are offset with respect to the remaining fiducial marks. These extra rows and columns are the ones that are furthest from the side edge 30 and the upper edge 32 of the printing medium 26, respectively, and serve as a reference for the position of the fiducial mark pattern, as will be described further below. Similar patterns may be provided in the vicinity of any of the remaining corners of the printing medium 26, as will later be described with reference to FIG. 4.

The respective distances between the fiducial marks 28 in the horizontal direction and in the vertical direction may be identical, but may also differ in order to accommodate for variations in the scanning resolution between the horizontal and vertical directions. For instance, in the example shown in FIG. 2, the fiducial marks 28 have a relative distance of 1 mm in the horizontal direction, but 1.5 mm in the vertical direction.

Returning to FIG. 1, the printing medium 26 with the fiducial mark pattern 24 is provided from the printing unit 14 to the image sensing unit 16. The image sensing unit 16 may be any device that is capable of capturing an image of the printing medium. In the context of the present invention, an image may be understood to be any representation of the printing medium 26 and the fiducial mark pattern 24 printed thereon, in particular a representation that preserves scales and relative sizes. The representation may be an analog or a digital representation of said printing medium. The representation may be a scan of the printing medium, but may also be a photographic representation. The image sensing unit 16 may be an optical scanner as it is integrated in many conventional photocopying machines or multi-purpose machines, but may also be a purpose-built scanner that is located externally to the printer or photocopying machine. The image sensing unit 16 communicates with the control unit 20 via a data line 22, and provides a scanned representation of the front side 26 of the printing medium to the control unit 20.

Figure 3:
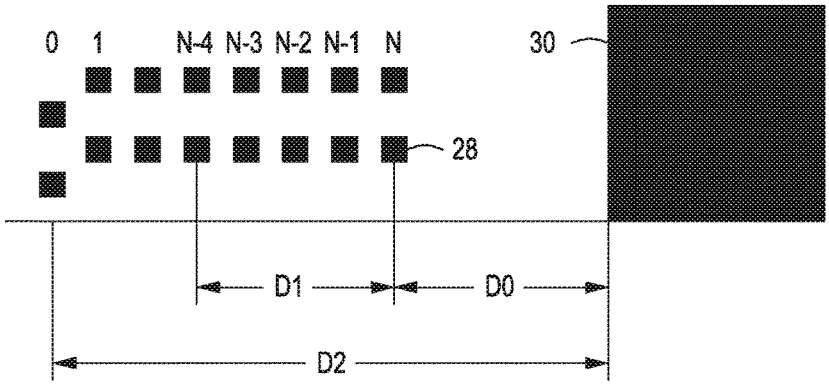
FIG. 3 illustrates the determination of a distance between the fiducial mark pattern and an edge of the printing medium in an example of the invention.

The control unit 20 comprises an identification unit (not shown) and a determination unit (not shown), which employ the captured representation of the printing medium 26 to determine the horizontal distance and the vertical distance of the fiducial mark pattern 24, respectively to the side edge 30 and upper edge 32 of the printing medium 26, as will now be described in further detail with reference to FIGS. 2 and 3. The identification unit may comprise image analysis tools to identify the fiducial marks 28 and the side edge 30 and upper edge 32 of the printing medium 26. A predetermined number of rows of the fiducial mark pattern 24 is then identified and selected as a horizontal target 34. In the example shown in FIG. 2, two rows of fiducial marks 28 constitute the horizontal target 34, but the horizontal target 34 may alternatively comprise only one row or more than two rows, depending on the application and the degree of accuracy that is desired. FIG. 3 is an enlarged image section that shows only the fiducial marks 28 of the horizontal target 34.

Once the fiducial marks 28 of the horizontal target 34 and the side edge 30 of the printing medium 26 have been identified in the scanned representation, the control unit 20 selects one of the rows of the horizontal target 34 for the distance measurement, such as the lowermost row. The fiducial marks 28 in this row are numbered 0, . . . N in FIG. 3, wherein 0 denotes the innermost mark and N denotes the outermost mark 28 that is fully or partially visible on the printing medium 26. In the example shown in FIGS. 2 and 3, all the fiducial marks 28 fit on the printing medium 26. However, depending on the paper size and the printing position this may not necessarily be the case, and the outermost mark (mark N) may be partially clipped. This is why mark N-1 instead of mark N is generally used as a basis for the measurement. From the scanned representation, the determination unit of the control unit 20 then determines the distance D0 between fiducial mark N-1 and the side edge 30 of the printing medium 26.

The resolution of the scanner 16 may be too low or unknown, and the scanning may introduce further image distortions. Hence, the distance D0 that is measured from the scanned representation of the image alone may not provide a sufficiently accurate measure of the distance between the fiducial mark pattern 24 and the side edge 30 of the printing medium 26. In order to compensate for these deficiencies, the determination unit additionally determines the distance D1 between the fiducial marks N-1 and N-4 in the scanned representation. The actual distance between the marks N-1 and N-4 on the printing medium 26 is predefined and known, and the ratio of the actual distance and the distance as measured from the scanned representation hence provides a correction factor that accommodates for the inaccuracies of the scanning process. This measurement correction factor is then applied to the measured distance D0 to obtain the actual distance between the fiducial mark N-1 and the side edge 30. The predefined distance between the outermost mark N-1 and the innermost mark 0 may then be added, and the result will be output as the computed distance between the side edge 30 of the printing medium 26 and the fiducial mark pattern 24.

The present invention accommodates variations in the image position, since the fiducial mark pattern 24 may be chosen sufficiently large such that there are always some marks close to the edge 30.

As an additional advantage, the method of the invention is robust to changes in the image resolution. The region of interest where D0 and D1 are measured is a small region over which the image resolution varies only little.

Since the determination of the horizontal and vertical distances involves some extrapolation, small errors can nevertheless become significant. As an example, the distance D0 may amount to 10 mm, and the reference distance D1 may amount to 4.5 mm. If the scanner resolution within the section covered by D0 is only 1% different from the resolution within the section covered by D1, the estimated distance D1 will have an error in the range of 10 mm×0.01=100 μm. If the estimated distance D1 has an error of 100 μm, the estimated distance D2 between the edge 30 and the reference mark 0 will have an error of 100 μm×10 mm/4.5 mm=222 μm.

In order to further reduce the errors resulting from the extrapolation, the estimation may be based on measurements of the distance D0 between the side edge 30 and a plurality of additional marks in the horizontal target 34, such as marks N-5, N-3 and N-2. The correction factor may then be determined based on an average that takes into account all these measurement values. The measurement of the distance D1 may likewise be backed up by measuring further distances between selected fiducial marks. Instead of entirely relying on the measured distance between marks N-1 and N-4, further differences such as N-1 to N-3, N-1 to N-5 and N-2 to N-5 may be measured and may be incorporated into the determination of the correction factor, such as by linear regression which takes into account the predefined distances between these marks.

Figure 4:
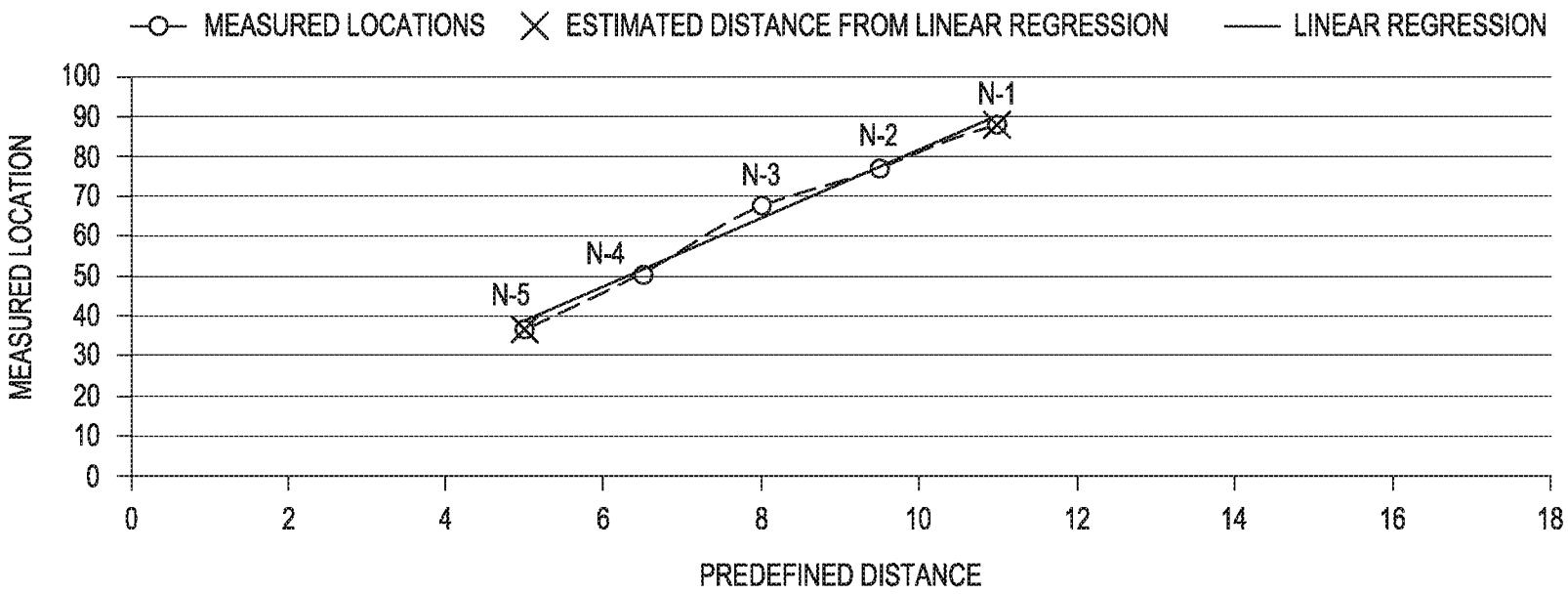
FIG. 4 illustrates the determination of a reference distance between fiducial marks based on linear regression according to an example of the invention.

FIG. 4 illustrates with an example how linear regression can be employed to obtain a more accurate estimate of the second distance by incooperating the measured locations of three or more fiducial marks of the fiducial mark pattern 24. The diagram shows the measured locations of marks N-5 to N-1 based on the captured representation of the image versus their true locations at predefined distances from a given reference, such as a reference mark or the side edge 30.

In the example shown in FIG. 4, the second distance D1 that shall be determined corresponds to the distance between the marks N-1 and N-5. The measured distances may not represent the true distance, due to image distortion and measurement errors. However, the intermediary fiducial marks N-2, N-3 and N-4 may be taken into account to enhance the accuracy. Since all the fiducial marks are printed at regular distances, we can use the measured locations of these fiducial marks and apply a linear regression analysis to determine the line that best maps the predefined distance into the measured distance. This line can then be employed to estimate the distance between the fiducial marks N-1 and N-5, and will in general yield a more accurate result since it mixes data from several measured data points.

The first distance and/or second distance may also be determined based on independent measurements for a plurality of fiducial marks. This helps to enhance the accuracy of determining the distance between the fiducial mark pattern and the edge.

In order to further enhance the accuracy, the distances D0 and D1 may be determined independently for additional rows of the horizontal target region 34, such as the upper row in FIG. 3. An average of the independent measurements could then be employed to determine the distance between the fiducial mark pattern and the edge.

The same techniques may be applied to measure the vertical distance between the fiducial mark pattern 24 and the upper side edge 32 of the printing medium 26, but employing the vertical target region 36 instead of the horizontal target region 34.

Figure 5:
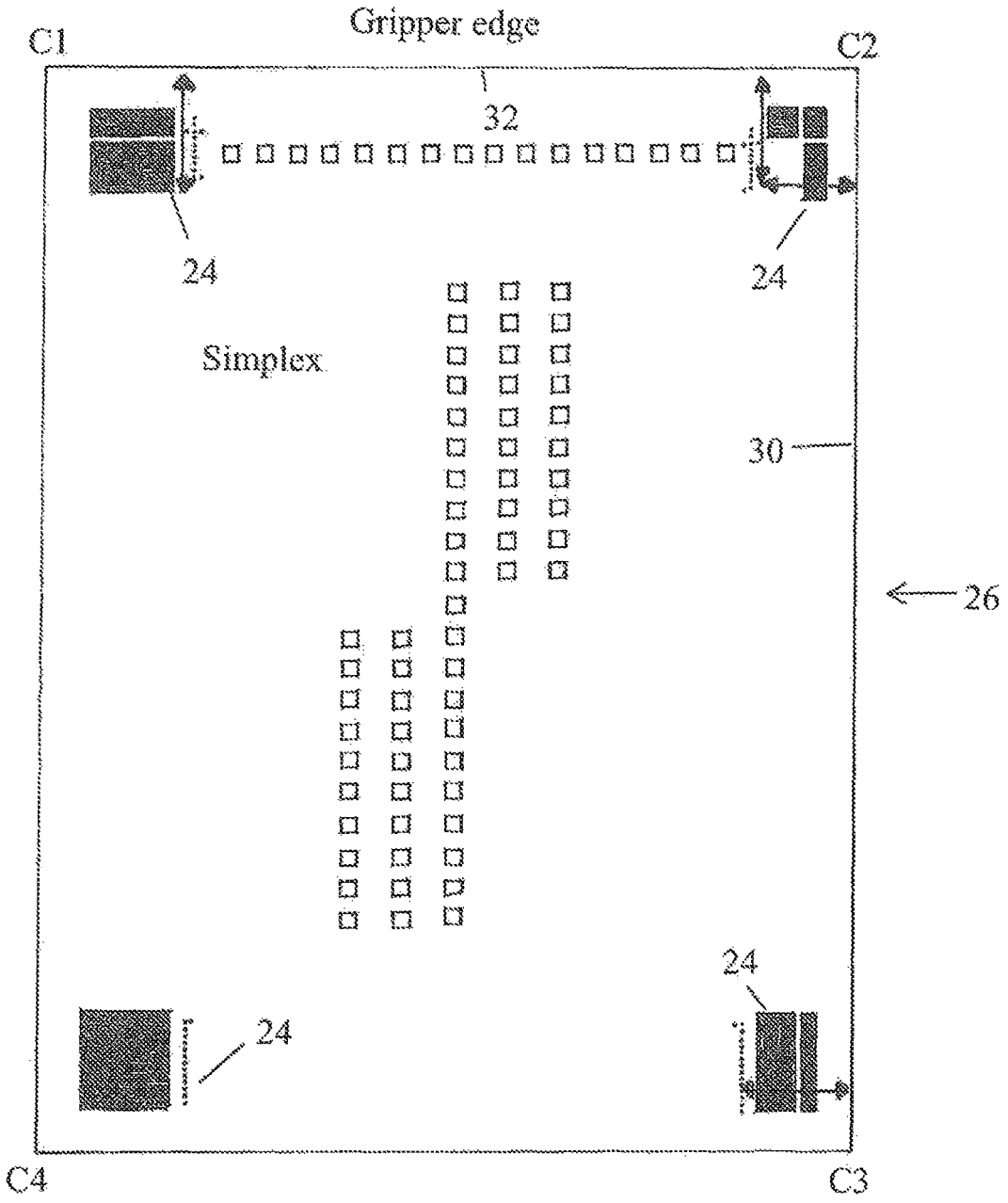
FIG. 5 shows a printing medium with four fiducial mark patterns in the vicinity of the respective corners of the printing medium according to an example of the invention.

The front side of the printing medium 26 may comprise more than one fiducial mark pattern 24. In particular, fiducial mark patterns that are similar or identical to the fiducial mark pattern 24 described with reference to FIGS. 2 and 3 above may be provided in the vicinity of some or all of the remaining corners C3, C4 and C1 of the front side 26 of the printing medium, as illustrated in FIG. 5. The fiducial mark patterns 24 at corners C3, C4 and C1 may be employed in the same way as described above for the corner C2 to determine the relative horizontal and vertical distances to the adjoining edges of the printing medium 26. In the example illustrated in FIG. 5, the upper right corner C2 serves as the primary reference. The vertical position may then be determined as the average of the positions at corners C1 and C2, whereas the horizontal position may be determined as the average of corners C2 and C3.

After the scanning of a simplex image, the printing medium may be output, as indicated in variant A in FIG. 1. However, the invention can likewise be employed for front-to-back adjustment in duplex printing, as will now be described with reference to FIGS. 1 and 5. In order for front-to-back adjusting, the printing medium will be diverted to the duplex unit 18 instead of being output after scanning of the front side at the image sensing unit 16, as illustrated in variant B in FIG. 1. The duplex unit 18 is likewise controlled by the control unit 20 via a data line 22. At the duplex unit 18, the printing medium is inverted from the front side to the back side and is sent back to the printing unit 14, where additional fiducial marks may be printed on the back side 38 of the printing medium. The fiducial mark patterns on the back side 38 of the printing medium may again be located in the vicinity of the corners C1, C2, C3 and C4 of the printing medium, and may be identical or similar to the fiducial mark pattern 24 on the front side 28, as described with reference to FIGS. 2 to 4 above.

After printing of the fiducial marks on the back side 38 of the printing medium, the printing medium is again passed on from the printing unit 14 to the image sensing unit 16 for scanning of the back side 38 of the printing medium. The scanned representation of the back side 38 of the printing medium is then again sent to the control unit 20 via the data line 22, and the horizontal and vertical image positions are determined in the same way.

In an alternative configuration, both the printing unit 14 and the image sensing unit 16 may have direct access to the duplex unit 18. Hence, the fiducial mark patterns 24 may be printed consecutively on the front side 26 and the back side 38 of the printing medium in the printing unit 14 before scanned representations of the front side 26 and back side 38 of the printing medium are then obtained in the image sensing unit 16.

Figure 6A:
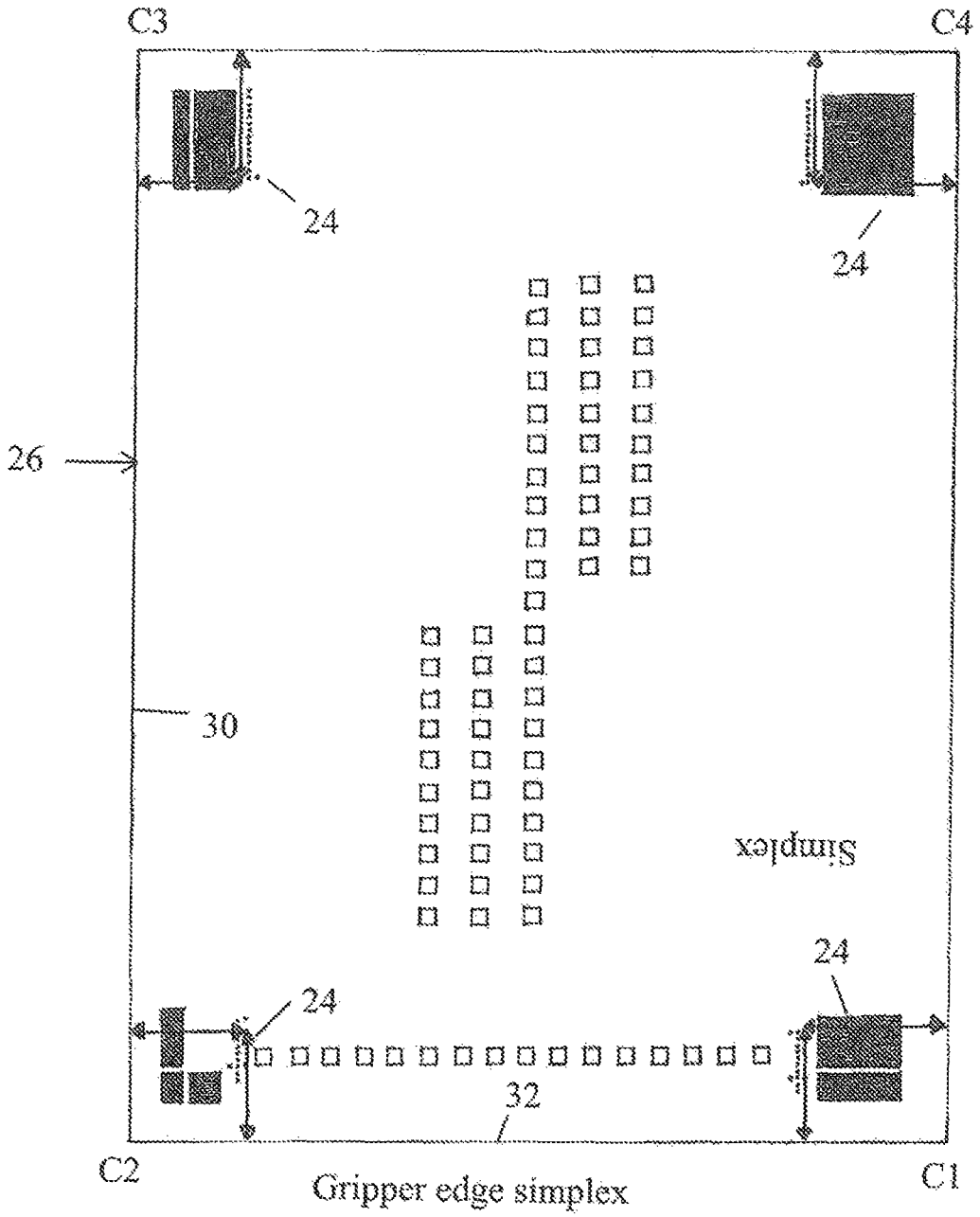
FIGS. 6*a* and 6*b* show the front side and back side of a printing medium for duplex image registration, with corresponding fiducial mark patterns according to an example of the invention.
Figure 6B:
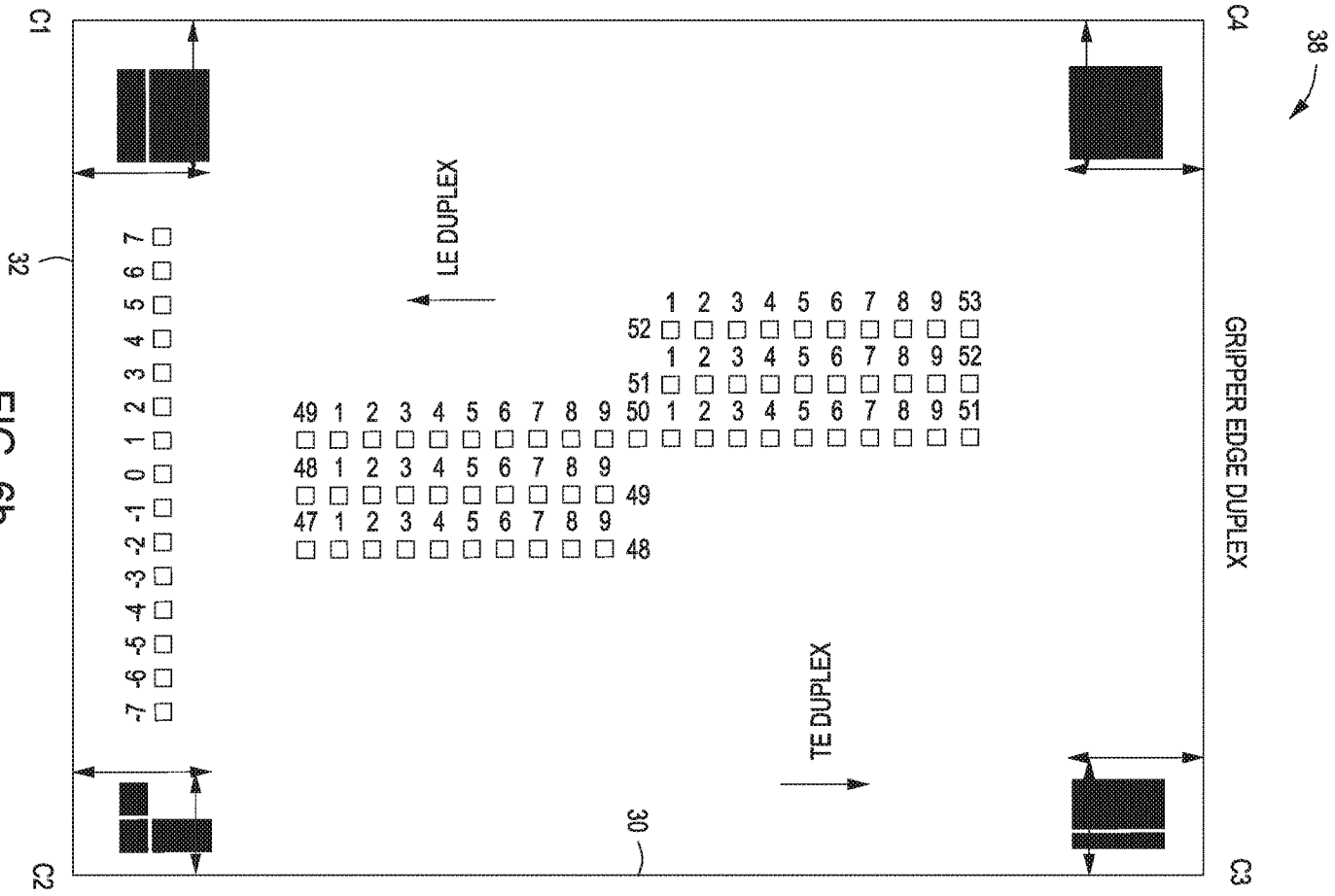

FIGS. 6*a* and 6*b* show scanned representations of the front side 26 and the back side 38 of the printing medium in a configuration in which the simplex side is captured upside down by the scanner 16. Employing the estimation algorithm as described with reference to FIGS. 2 to 4 above, the image position may now be determined both for the front side 26 and the back side 38 of the printing medium, and may be adjusted so that the images of the front side 26 and the back side 38 are perfectly aligned.

In some printing systems, the measurements at the bottom of a page or image may have larger positioning errors than at the top, as the paper movement may be less stable there. This effect may be particularly pronounced in duplex printing, since most of the page has already left the scanner exit assembly once the trailing edge of the duplex side is scanned. In order to accommodate for these effects, measurements at the lower corners may be given lower error weights than measurements at the upper corners when the errors at the four corners are averaged. For instance, for the vertical location the errors at the corners C3 and C4 (the top corners in the inverted configuration of FIGS. 6*a* and 6*b*) may be given a weight of 1.0, whereas the errors at the bottom corners C1 and C2 may be given a lower weight of 0.5.

The image-on-paper registration according to the present invention may be employed to calibrate each print arm and each paper type of the printing system 10 individually, both for simplex as well as for duplex printing. The adjustment according to the present invention may be performed automatically whenever a new paper group or substrate is loaded into the paper feeding unit 12.

For instance, for calibration three pages with fiducial marks may be printed for the first arm.

A scan will be performed for all the four corners of the page as described with reference to FIGS. 2 to 6 above, and the adjustment of the printing position will be made based on an average of the three measurements. After calibrating the first print arm, the same calibration can be performed for the second print arm.

REFERENCE SIGNS

10 printing system
12 paper feeding unit
14 printing unit
16 image sensing unit
18 duplex unit
20 control unit
22 data lines
24 fiducial mark pattern
26 (front side of) printing medium
28 fiducial marks
30 side edge of printing medium 26
32 upper edge of printing medium 26
34 horizontal target
36 vertical target
38 back side of printing medium

What is claimed is:

1. A method for determining a printing position, the method comprising:

providing at least a first and second fiducial mark pattern on a printing medium, each of the first and second fiducial mark pattern comprising a respective plurality of fiducial marks at predefined relative distances;

capturing an image of the printing medium;

with each of the first and second fiducial mark patterns:

identifying the respective plurality of fiducial marks in a captured representation of the printing medium;

identifying a first edge of the printing medium in the captured representation of the printing medium;

determining a first distance between the first edge and a respective first fiducial mark of each of the first and second fiducial mark patterns from the captured representation of the printing medium;

determining a plurality of second distances between the respective plurality of fiducial marks from the captured representation of the printing medium; and computing a distance between each of the first and second fiducial mark patterns and the first edge based on the determined first distance and the plurality of determined second distances, wherein computing the distance between each of the first and second fiducial mark patterns and the first edge comprises a linear regression based on the plurality of determined second distances and predetermined distances between the respective fiducial marks; and averaging the computed distances between each of the first and second fiducial mark patterns and the first edge; and calibrating the printing device using the computed average distance.

2. The method of claim 1, wherein the first fiducial mark pattern is in the upper right corner of the printing medium.

3. The method of claim 2, wherein the second fiducial mark pattern is in the upper left corner of the printing medium.

4. The method of claim 3, wherein the average of the computed distances between each of the first and second fiducial mark pattern determines the vertical position of the printing medium to be used during calibration.

5. The method of claim 2, wherein the second fiducial mark pattern is in the lower right corner of the printing medium.

6. The method of claim 2, wherein the second fiducial mark pattern is in the lower left corner of the printing medium.

7. The method of claim 1, wherein the average of the computed distances between each of the first and second fiducial mark pattern determines the horizontal position of the printing medium to be used during calibration.

8. The method of claim 1, wherein computing the distance between each of the first and second fiducial mark patterns and the first edge comprises comparing the determined second distance with a predefined relative distance between a respective second fiducial mark and a respective third fiducial mark.

9. The method of claim 8, wherein the computing the distance between each of the first and second fiducial mark patterns and the first edge comprises adjusting the determined first distance with a correction factor derived from the comparison of the determined second distance with the predefined relative distance between the respective second fiducial mark and the respective third fiducial mark.

10. The method of claim 1, wherein the respective second fiducial mark coincides with the respective first fiducial mark.

11. The method according to claim 1, wherein the respective first fiducial marks are fiducial marks that are closest to the first edge among the fiducial marks of the respective fiducial mark patterns.

12. The method of claim 1, wherein a predefined relative distance between the fiducial marks of each of the fiducial mark patterns in a horizontal direction of the fiducial mark patterns differs from a predefined relative distance between the fiducial marks in a vertical direction of the fiducial mark pattern, the vertical direction perpendicular to the horizontal direction.

13. The method of claim 1, wherein the fiducial marks of the fiducial mark pattern are provided on a common surface side of the printing medium.

14. The method of claim 1, the method comprising adjusting a front-to-back printing position of the printing medium based on the respective distances between the respective first and second fiducial mark patterns and respective horizontal and vertical edges of the printing medium.

15. The method of claim 1, further comprising associating different error weights to the computed distances between each of the first and second fiducial mark patterns and the first edge.

16. A system for determining a printing position, comprising:

a printing unit to print at least a first and second fiducial mark pattern on a printing medium, the first and second fiducial mark patterns comprising a respective plurality of fiducial marks at predefined relative distances;

an image sensing unit to capture an image of the printing medium;

an identification unit to identify the respective fiducial marks in a captured representation of the printing medium and to identify a first edge of the printing medium in the captured representation of the printing medium;

a determination unit to:

determine a first distance between the first edge and a first fiducial mark of each of the respective first and second fiducial mark patterns from the captured representation of the printing medium;

determine a second distance between a second fiducial mark of each of the respective first and second fiducial mark patterns and a third fiducial mark of each of the respective first and second fiducial mark patterns from the captured representation of the printing medium;

to compute a distance between each of the first and second fiducial mark patterns and the first edge based on the determined first distance and the determined second distance; and average the computed distances between each of the first and second fiducial mark patterns and the first edge.

17. The system of claim 16, wherein the first fiducial mark pattern is in the upper right corner of the printing medium, the second fiducial mark pattern is in the upper left corner of the printing medium, and the average of the computed distances between each of the first and second fiducial mark pattern determines the vertical position of the printing medium to be used during calibration.

18. The system of claim 16, wherein the first fiducial mark pattern is in the upper right corner of the printing medium, the second fiducial mark pattern is in the lower right corner of the printing medium, and the average of the computed distances between each of the first and second fiducial mark pattern determines the horizontal position of the printing medium to be used during calibration.

19. A computer program product for determining a printing position, the computer program product comprising:

a non-transitory computer readable storage medium comprising computer usable program code embodied therewith, the computer usable program code to, when executed by a processor:

receive a representation of a printing medium, the print medium being provided with at least a first and second fiducial mark patterns, the first and second fiducial mark patterns comprising a respective plurality of fiducial marks at predefined relative distances; and with regards to each of the first and second fiducial mark patterns;

identify the respective plurality of fiducial marks in the representation of the printing medium;

identify a first edge of the printing medium in the captured representation of the printing medium;

determine a first distance between the first edge and a respective first fiducial mark of each of the first and second fiducial mark patterns from the captured representation of the printing medium;

determine a plurality of second distances between the respective plurality of fiducial marks from the captured representation of the printing medium;

computing a distance between each of the first and second fiducial mark patterns and the first edge based on the determined first distance and the plurality of determined second distances, wherein computing the distance between each of the first and second fiducial mark patterns and the first edge comprises a linear regression based on the plurality of determined second distances and predetermined distances between the respective fiducial marks; and averaging the computed distances between each of the first and second fiducial mark patterns and the first edge.

20. The computer program product of claim 19, wherein computing the distance between each of the first and second fiducial mark patterns and the first edge comprises comparing the determined second distance with a predefined relative distance between a respective second fiducial mark and a respective third fiducial mark.

* * * * *